US007441540B1

(12) United States Patent
Minami

(10) Patent No.: US 7,441,540 B1
(45) Date of Patent: Oct. 28, 2008

(54) MULTIPOINT IGNITION DEVICE

(75) Inventor: Katsuaki Minami, Nagano (JP)

(73) Assignee: Miyama, Inc., Nagano (JP)

( * ) Notice: Subject to any disclaimer, the term of this patent is extended or adjusted under 35 U.S.C. 154(b) by 0 days.

(21) Appl. No.: 11/976,524

(22) Filed: Oct. 25, 2007

(30) Foreign Application Priority Data

Aug. 6, 2007 (JP) ..... 2007-203838

(51) Int. Cl.
*F02P 15/08* (2006.01)
*F02P 15/10* (2006.01)
*F02P 13/00* (2006.01)

(52) U.S. Cl. ..... 123/310; 123/169 MG

(58) Field of Classification Search ..... 123/310, 123/169 MG, 169 EL, 145 A, 143 B; 313/141
See application file for complete search history.

(56) References Cited

U.S. PATENT DOCUMENTS 5,046,466 A * 9/1991 Lipski ..... 123/310
6,161,520 A * 12/2000 Clarke ..... 123/310
7,299,785 B1 * 11/2007 Lee ..... 123/310
2007/0209634 A1 * 9/2007 Minami ..... 123/310

FOREIGN PATENT DOCUMENTS

| | | |
|---|---|---|
| JP | 58-071581 | 4/1983 |
| JP | 01-193080 | 8/1989 |
| JP | 02-123281 | 5/1990 |
| JP | 07-012037 | 1/1995 |
| JP | 2006-132413 | 5/2006 |

* cited by examiner

*Primary Examiner*—Stephen K Cronin
*Assistant Examiner*—Arnold Castro
(74) *Attorney, Agent, or Firm*—Rabin & Berdo, PC

(57) ABSTRACT

A multipoint ignition device comprises: a head gasket (1) interposed between a cylinder head and a cylinder block of an engine, having an opening (3) in a position corresponding to a cylinder opening portion; and a plurality of intermediate members (6) connected respectively to a plurality of electrode pairs (2) and held by the head gasket (1). A part of at least one of the plurality of intermediate members (6) is exposed to the opening (3).

5 Claims, 4 Drawing Sheets

MULTIPOINT IGNITION DEVICE

TECHNICAL FIELD OF THE INVENTION

This invention relates to a multipoint ignition device used in a multipoint ignition engine having a plurality of ignition gaps in a single combustion chamber.

BACKGROUND OF THE INVENTION

JP2-123281A and JP1-193080A disclose a multipoint ignition engine in which a plurality of electrode pairs constituting ignition gaps are disposed around a cylinder opening portion of an engine such that an air-fuel mixture in a combustion chamber is ignited from the plurality of ignition gaps. According to this constitution, in comparison with a case in which ignition is performed using a conventional spark plug that performs ignition only from the center of the combustion chamber, combustion of the air-fuel mixture in a peripheral edge portion of the combustion chamber is promoted, enabling improvements in engine output and fuel economy.

SUMMARY OF THE INVENTION

When the temperature of the electrode pair is lower than a self-cleaning temperature, carbon sticks to the vicinity of the electrode pair such that a spark can no longer fly from the electrode pair. Conversely, when the temperature of the electrode pair rises excessively, the electrode pair itself becomes a heat source, and therefore pre-ignition occurs, causing ignition before the spark flies. Hence, a method of adjusting the heat value of an ignition device to an appropriate value is also required in a multipoint ignition device such as that described above.

This invention has been designed in consideration of these problems in the prior art, and it is an object thereof to provide a heat value adjustment method for a multipoint ignition device.

A multipoint ignition device according to this invention comprises: an interposed member interposed between a cylinder head and a cylinder block of an engine, having an opening in a position corresponding to a cylinder opening portion; and a plurality of intermediate members connected respectively to a plurality of electrode pairs and held by the interposed member. A part of at least one of the plurality of intermediate members is exposed to the opening.

According to this invention, a part of the intermediate member connected to the electrode pair is exposed to the opening, which constitutes a part of a combustion chamber. Hence, by adjusting the exposure area of the intermediate member, the amount of heat received by the multipoint ignition device from the combustion gas can be adjusted, whereby the heat value of the multipoint ignition device can be adjusted.

DESCRIPTION OF THE PREFERRED EMBODIMENT

An embodiment of this invention will be described below with reference to the attached drawings.

Figure 1:
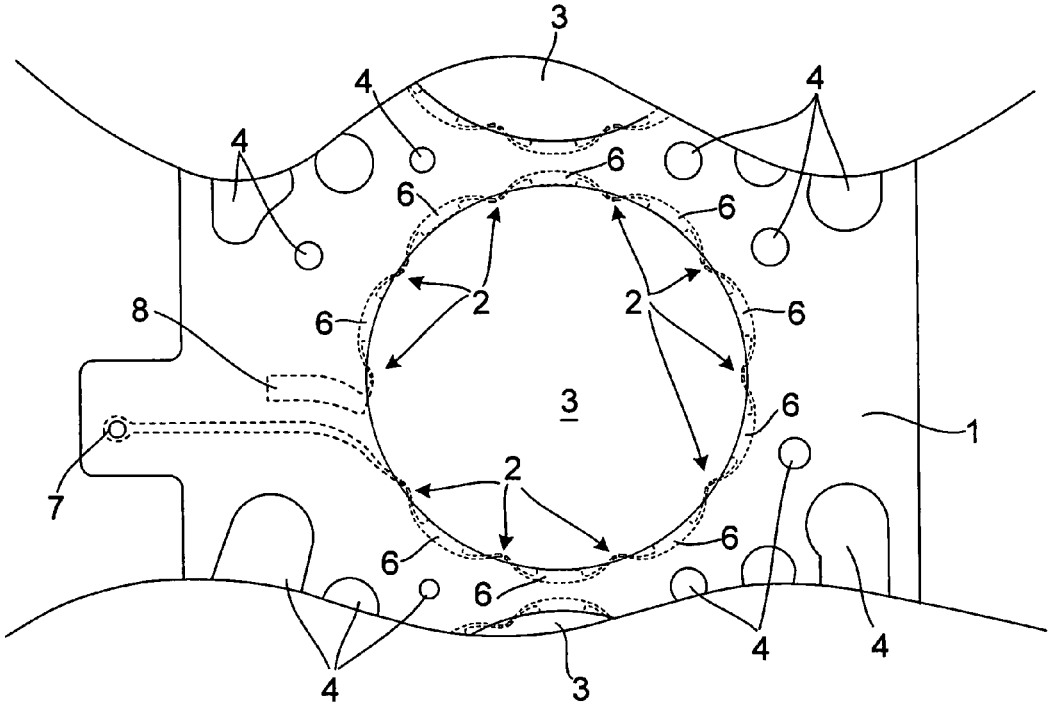
FIG. 1 is a constitutional diagram of a multipoint ignition device according to this invention.
Figure 2:
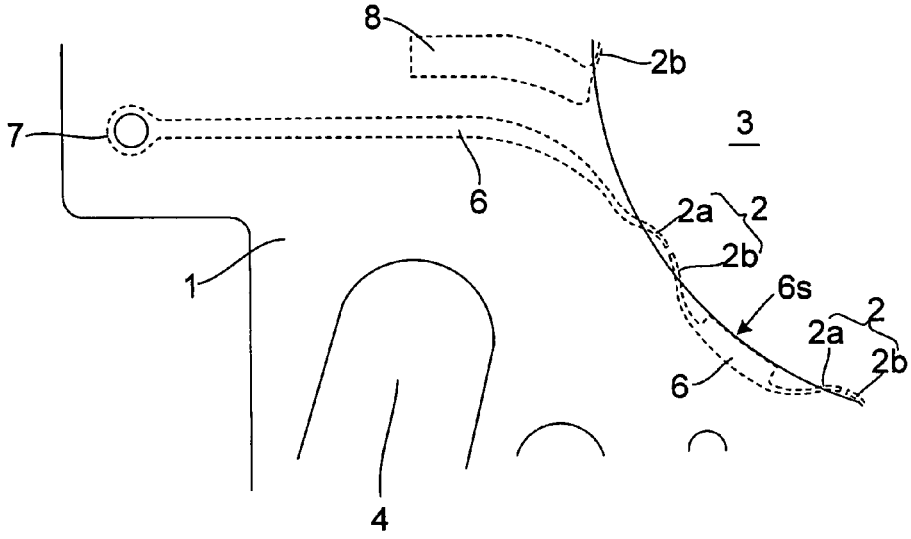
FIG. 2 is a partially enlarged view of the multipoint ignition device according to this invention.

FIG. 1 shows the constitution of a multipoint ignition device according to this invention, and FIG. 2 is a partially enlarged view thereof. In this embodiment, a multipoint ignition device is formed integrally with a head gasket 1 of an engine, and when the multipoint ignition device is sandwiched between a cylinder head and a cylinder block of the engine, a plurality of electrode pairs 2 are disposed around a cylinder opening portion. Each electrode pair 2 is constituted by a current-carrying electrode 2*a* and an earth electrode 2*b*, and an ignition gap is formed between the electrodes 2*a*, 2*b*.

The head gasket 1 is formed with a plurality of openings 3, 4. The largest, central opening 3 has a substantially identical diameter to the cylinder opening portion, and is formed in a position corresponding to the cylinder opening portion so as to form a part of a side wall of a combustion chamber when attached to the engine.

The openings 4 disposed on the periphery of the opening 3 are water holes connected to cooling water passages formed in the cylinder head and cylinder block.

An intermediate member 6 formed from a conductive material is connected to each of the plurality of electrode pairs 2, and by holding the intermediate members 6 in the head gasket 1, the plurality of electrode pairs 2 are held on the head gasket 1. In this example, the electrode pairs 2 and intermediate members 6 are formed integrally from an identical material having a high heat resistance property, such as nickel, and although the boundary between the two members is not evident, for ease of description the thick part in the diametrical direction of the opening 3 will be referred to as the intermediate member 6, and the part that extends in a gently curving S shape from the intermediate member 6 to the two sides and projects partially into the opening 3 will be referred to as the electrode pair 2.

The plurality of electrode pairs 2 are electrically connected in series via the intermediate members 6. Hence, when a high secondary voltage is applied to a terminal 7, discharge occurs first in the ignition gap of the electrode pair 2 having the current-carrying electrode 2*a* that is connected to the terminal 7, after which discharge occurs in the adjacent electrode pair 2 thereto. Discharge then occurs around the opening 3 in sequence from the terminal 7 side until finally, discharge occurs in the ignition gap of the electrode pair 2 that is closest to an earth terminal 8.

Further, each intermediate member 6 extends to a peripheral edge of the opening 3, and a tip end surface thereof is exposed to an inner peripheral surface of the opening 3. In the multipoint ignition device according to this invention, the heat value can be adjusted by modifying the surface area of this part (to be referred to hereafter as the "exposure area").

To describe the heat value adjustment method specifically, to reduce the heat value of the multipoint ignition device (to make the multipoint ignition device a hot type ignition device), the exposure area of the intermediate member 6 should be increased. When the exposure area increases, the amount of heat received by the intermediate member 6 from the combustion gas increases, making the temperature of the electrode pair 2 less likely to fall, and thus the heat value of the multipoint ignition device can be reduced.

Figure 3:
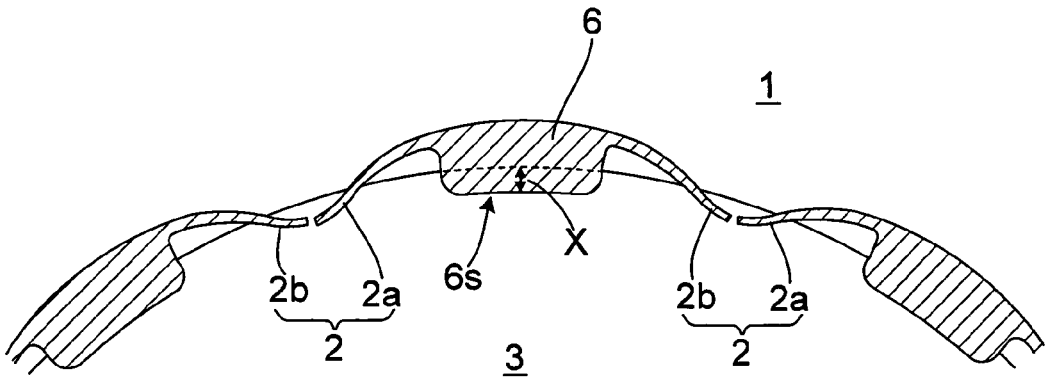
FIGS. 3 to 8 are views illustrating a heat value adjustment method.
Figure 4:
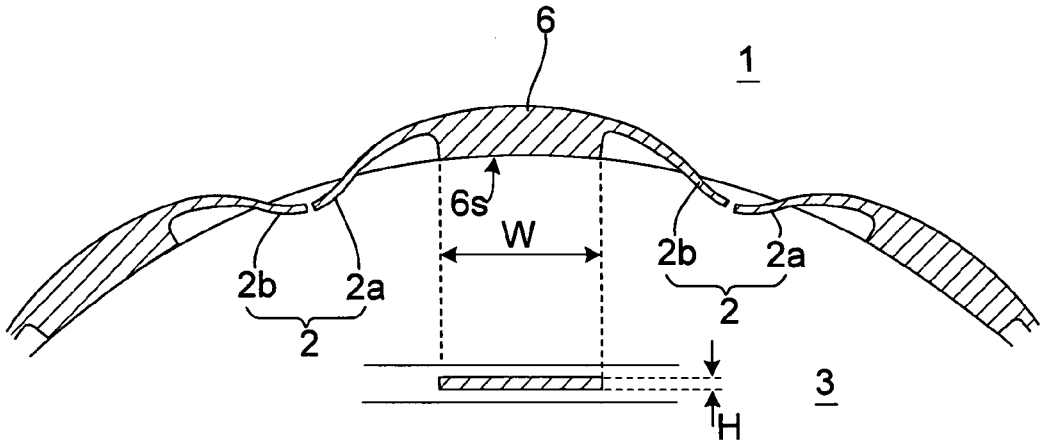

To increase the exposure area of the intermediate member 6, a projection amount X by which the intermediate member 6 is caused to project into the opening 3 may be increased, as shown in FIG. 3, or a width W of the exposed part of the intermediate member 6 may be increased, as shown in FIG. 4. A height H of the exposed part of the intermediate member 6 may also be increased provided that electric leakage from the intermediate member 6 into the cylinder head and cylinder block does not occur.

Figure 5:
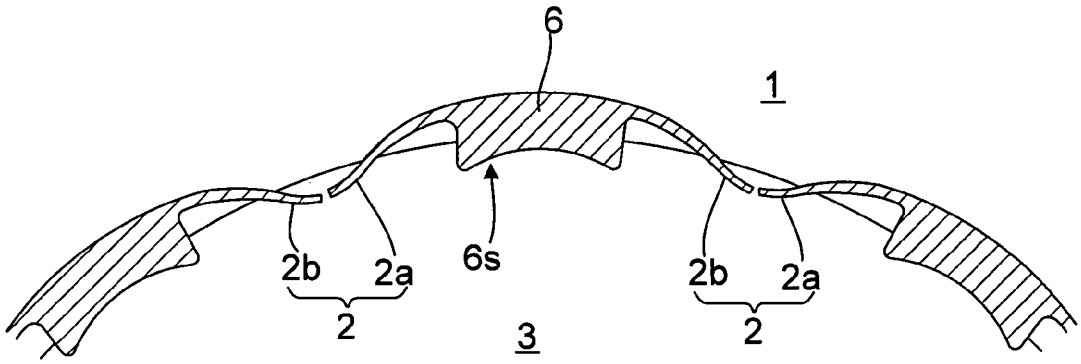

When the intermediate member 6 is caused to project into the opening 3, the heat value may be reduced further by bending a tip end surface 6*s* of the projecting part to increase the surface area thereof, as shown in FIG. 5. Any surface may be bent as long as it belongs to the projecting part. The surface area of the projecting part may also be increased by forming grooves, indentations, projections and the like on the surface instead of bending the surface.

Figure 6:
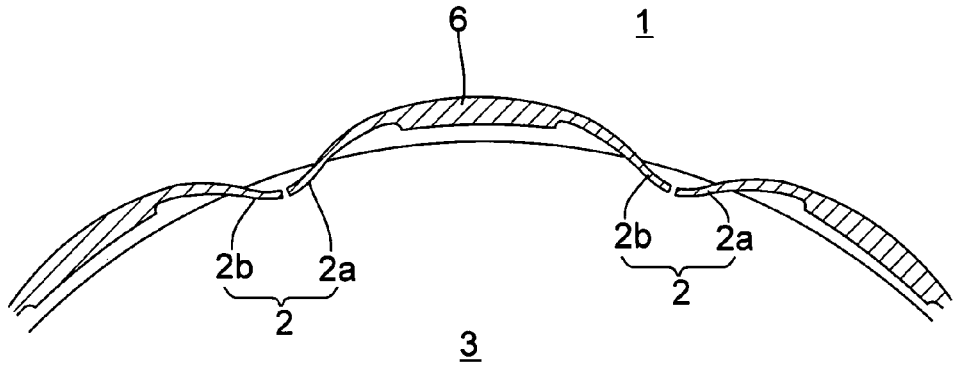

Conversely, to raise the heat value of the multipoint ignition device (to make the multipoint ignition device a cold type ignition device), the exposure area of the intermediate member 6 should be reduced, in contrast to a case in which the heat value is reduced. To reduce the heat value further, the intermediate member 6 may be completely buried in the interior of the head gasket 1, as shown in FIG. 6, to make the exposure area of the intermediate member 6 zero.

It should be noted that in this embodiment, the intermediate member 6 extends to the peripheral edge of the opening 3 so as to be exposed to the opening 3, but a side hole extending in the diametrical direction of the opening 3 or a groove extending in the circumferential direction of the opening 3 may be formed in the inner peripheral surface of the opening 3 such that a part of the intermediate member 6 is exposed to the opening 3 via the side hole or groove.

Further, in this embodiment all of the intermediate members 6 have the same exposure area, but when the heat value required for each electrode pair 2 is different, the exposure area of the intermediate member 6 may be modified according to its position. For example, the electrode pair 2 on an exhaust port side has a higher temperature than the electrode pair 2 on an intake port side, and therefore, by reducing the exposure area of the intermediate member 6 disposed on the exhaust port side, the heat value can be raised.

Figure 7:
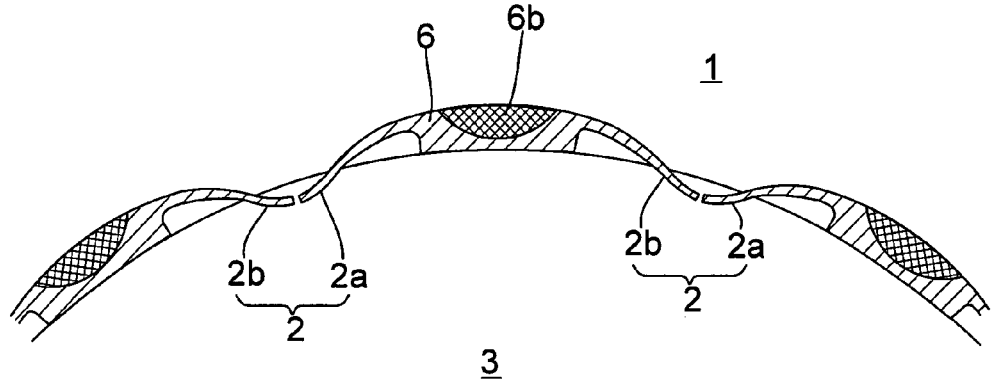
Figure 8:
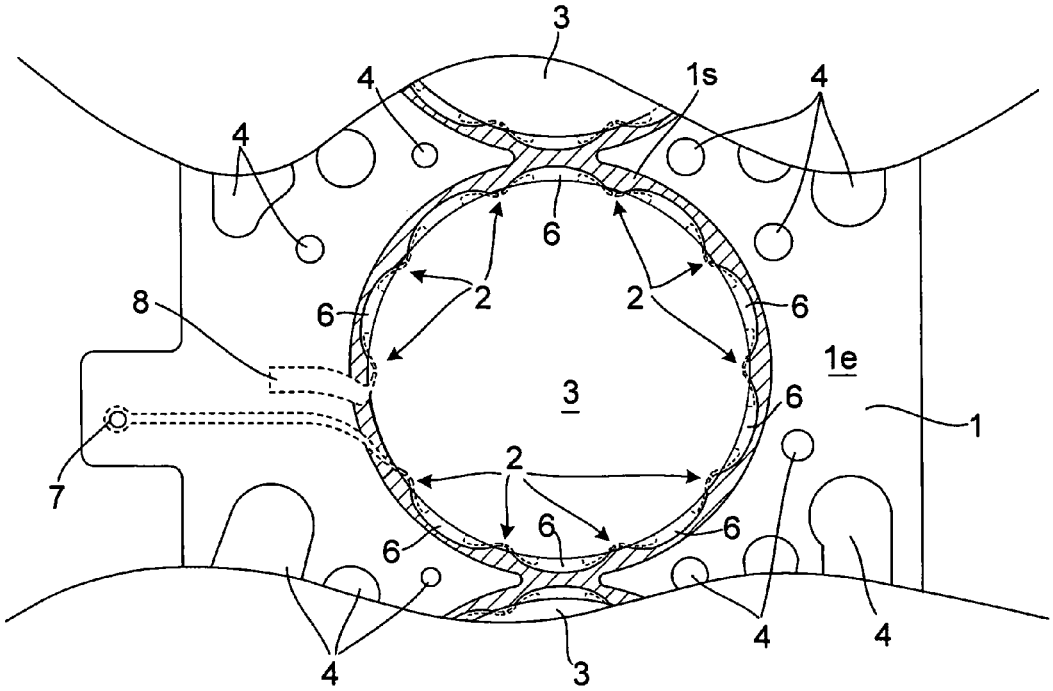

Furthermore, to realize wider-range heat value adjustment, the constitutions shown in FIGS. 7 and 8 may be employed where appropriate in addition to the constitutions described above.

FIG. 7 shows a constitution in which the intermediate member 6 is formed from a plurality of materials having different thermal conductivity values, thereby enabling wider-range heat value adjustment. In this example, the part of the intermediate member 6 that is connected to the electrode pair 2 and the vicinity of the part that is exposed to the opening 3 are formed from the same material as the electrode pair 2, i.e. a material exhibiting excellent heat resistance such as nickel, whereas a part 6*b* on the opposite side of the opening 3 is formed from a material having high thermal conductivity such as copper.

According to this constitution, the amount of heat that is radiated from the intermediate member 6 to the cylinder head and cylinder block through the head gasket 1 increases, and as a result, the heat value of the multipoint ignition device can be raised. When an even greater heat value is required, the entire intermediate member 6 may be formed from a material having high thermal conductivity, such as copper.

In addition to the constitution shown in FIG. 7, the intermediate member 6 may be formed from a plurality of materials having different thermal conductivity values by forming the outer side of the intermediate member 6 from a material exhibiting excellent heat resistance, such as nickel, and burying a material having high thermal conductivity, such as copper, in the interior thereof (a shell structure). Alternatively, a material having high thermal conductivity, such as copper, may be sandwiched from both sides by a material exhibiting excellent heat resistance, such as nickel (a sandwich structure). Further, the material having high thermal conductivity, such as copper, may be applied in the form of a metal powder so that distortion caused by differences in the thermal expansion coefficient of the different materials can be absorbed.

FIG. 8 shows a constitution in which a holding portion is of the head gasket 1, which holds the intermediate member 6, is formed from an insulating material such as a ceramic, and a part 1*e* of the head gasket 1 other than the holding portion 1*s* is formed from a different insulating material to the material of the holding portion 1*s*.

According to this constitution, by forming the part 1*e* other than the holding portion 1*s* from a material having high thermal conductivity, such as aluminum, the amount of heat radiated from the intermediate member 6 to the cylinder head and cylinder block through the head gasket 1 can be increased, enabling an increase in the heat value of the multipoint ignition device. Moreover, the amount of heat that is transferred from the cylinder head to the cylinder block through the head gasket 1 increases, and therefore knocking, which occurs when the temperature of the cylinder head becomes excessive, can be suppressed.

Conversely, to lower the heat value of the multipoint ignition device, the part 1*e* other than the holding portion is may be formed from a material having low thermal conductivity, such as zirconia, to reduce the amount of heat that is radiated from the intermediate member 6 to the cylinder head and cylinder block through the head gasket 1.

It should be noted that the specific heat value adjustment methods described above may be executed in appropriate combinations, and in so doing, wider-range heat value adjustment can be realized.

What is claimed is:

1. A multipoint ignition device in which a plurality of electrode pairs, each constituting an ignition gap, are disposed around a cylinder opening portion of an engine, comprising:

an interposed member interposed between a cylinder head and a cylinder block of the engine, holding base portions of the plurality of electrode pairs and having an opening in a position corresponding to the cylinder opening portion; and a plurality of intermediate members held by the interposed member and connected respectively to the base portions of the plurality of electrode pairs held by the interposed member, wherein a part of at least one of the plurality of intermediate members is exposed to the opening.

2. The multipoint ignition device as defined in claim 1, wherein the part exposed to the opening projects into the opening.

3. The multipoint ignition device as defined in claim 2, wherein an irregularity is formed on a surface of the projecting part.

4. The multipoint ignition device as defined in claim 1, wherein the intermediate member and the plurality of electrode pairs are formed from materials having different thermal conductivity values, or the intermediate member is formed from a plurality of materials having different thermal conductivity values.

5. The multipoint ignition device as defined in claim 1, wherein a holding portion of the interposed member, which holds the plurality of intermediate members, and a part of the interposed member other than the holding portion are formed from materials having different thermal conductivity values.

* * * * *